United States Patent [19]

Steiger

[11] Patent Number: 4,754,733

[45] Date of Patent: Jul. 5, 1988

[54] FUEL INJECTION DEVICE FOR RECIPROCATING INTERNAL COMBUSTION ENGINE

[75] Inventor: Anton Steiger, Illnau, Switzerland

[73] Assignee: Sulzer Brothers Limited, Winterthur, Switzerland

[21] Appl. No.: 11,201

[22] Filed: Feb. 4, 1987

[30] Foreign Application Priority Data

Feb. 12, 1986 [CH] Switzerland ..... 562/86

[51] Int. Cl.[4] ..... F02M 47/02

[52] U.S. Cl. ..... 123/299; 123/27 GE; 239/533.3

[58] Field of Search ..... 123/299, 304, 27 GE, 123/575, 472, 445, 446; 239/533.3, 552

[56] References Cited

U.S. PATENT DOCUMENTS 3,753,424 8/1973 Haidvogel ..... 123/27 GE
4,151,958 5/1979 Hofmann ..... 239/533.3
4,202,500 5/1980 Keiczek ..... 239/533.3
4,546,739 10/1985 Nakajima et al. ..... 123/299
4,603,674 8/1986 Tanaka ..... 123/27 GE X
4,619,240 10/1986 Bedford et al. ..... 123/304 X
4,637,353 1/1987 Codrington ..... 123/27 GE

FOREIGN PATENT DOCUMENTS 0201921 11/1984 Japan ..... 123/299
0228766 11/1985 Japan ..... 123/299

*Primary Examiner*—Willis R. Wolfe
*Attorney, Agent, or Firm*—Kenyon & Kenyon

[57] ABSTRACT

The fuel injection valve has a central aperture for the injection of diesel oil into a combustion chamber as well as additional apertures above the central aperture for selective injection of diesel oil. The valve is controlled so that a needle valves opens only the central aperture when diesel oil is to be injected as an ignition fuel during gas operation. The needle valve is moved a greater distance to open all the apertures when diesel operation occurs.

20 Claims, 2 Drawing Sheets

FUEL INJECTION DEVICE FOR RECIPROCATING INTERNAL COMBUSTION ENGINE

Figure 1:
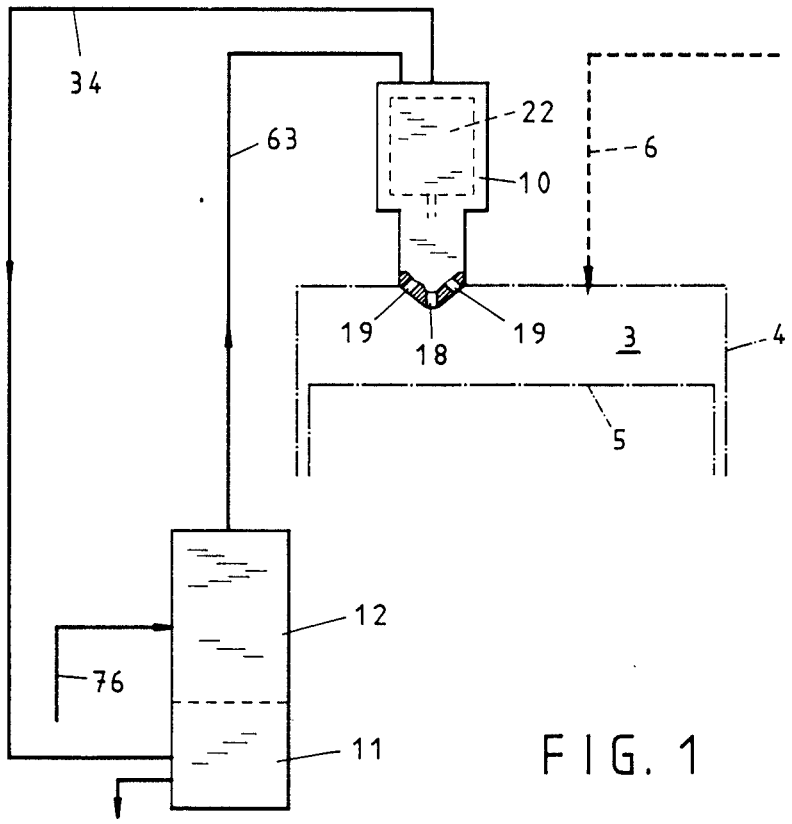

This invention relates to a fuel injection device for a reciprocating internal combustion engine. More particularly, this invention relates to a fuel injection device for optionally injecting ignition fuel or main fuel to a combustion chamber of a reciprocating internal combustion engine operated with diesel fuel or gas as the main fuel.

Heretofore, four-stroke reciprocating internal combustion engines have been known which can be operated on an optional basis with either diesel fuel or gas as a main fuel. In such engines, for gas operation, a quantity of ignition fuel consisting of diesel oil has been injected into the combustion chamber through the same injection apertures as those through which the diesel oil is injected when the engine is operated with diesel oil as the main fuel. Since the amount of ignition fuel should be 5 to 10 percent of the amount injected at full load in the case of diesel operation, the ignition fuel injection quality is poor in the case of gas operation. This is because the entire injection aperture cross section is too large for such small injection quantities, particularly since the trend today is to reduce the amount of ignition fuel injected to one percent and less. Further, in previously known fuel injection devices, the injection of such small quantities of fuel with accurate control has been impossible at the same pressure as is the case for the larger quantity when the engine is operated with diesel oil as the main fuel.

Accordingly, it is an object of the invention to be able to inject relatively small quantities of ignition fuel with accurate control in an engine which is to be optionally operated with diesel oil and gas.

It is another object of the invention to provide a fuel injection device which is capable of injecting very small quantities of ignition fuel at high pressure with exactly the same accurate control as in the case with much larger quantities injected when an engine is operated with diesel oil as a main fuel.

It is another object of the invention to provide a relatively simple fuel injection device which can be used for gas operation or diesel oil operation of an internal combustion engine.

Briefly, the invention provides a fuel injection device for a combustion chamber of a reciprocating internal combustion engine which includes a timed injection valve having at least one aperture for injection of diesel oil as an ignition fuel into a combustion chamber and additional apertures for injection of diesel oil as a main fuel into the combustion chamber. In accordance with the invention, a control means is provided for selectively opening only the ignition fuel aperture when the combustion chamber is operated with gas as a main fuel and opening that aperture and the additional apertures cyclically when the combustion chamber is to be operated with diesel oil as the main fuel.

The operation of the fuel injection device is such that the additional injection apertures are out of operation when the diesel oil is injected as an ignition fuel.

With this construction of the fuel injection device, the injection aperture cross-section for the ignition fuel injection can be given the optimum dimensions for a small quantity of one percent or less. Hence, with gas as the main fuel, the ignition fuel injection is of the optimum quality because the larger total cross-section of the diesel fuel injection apertures through which injection takes place when the engine is operated with diesel oil is out of operation. When the engine is operated with diesel fuel as in the main fuel, the diesel injection apertures then come into operation in an additional manner. In this regard, the total cross-section of these additional apertures is dimensioned for the then much larger quantity of diesel oil to be injected.

Figure 2:
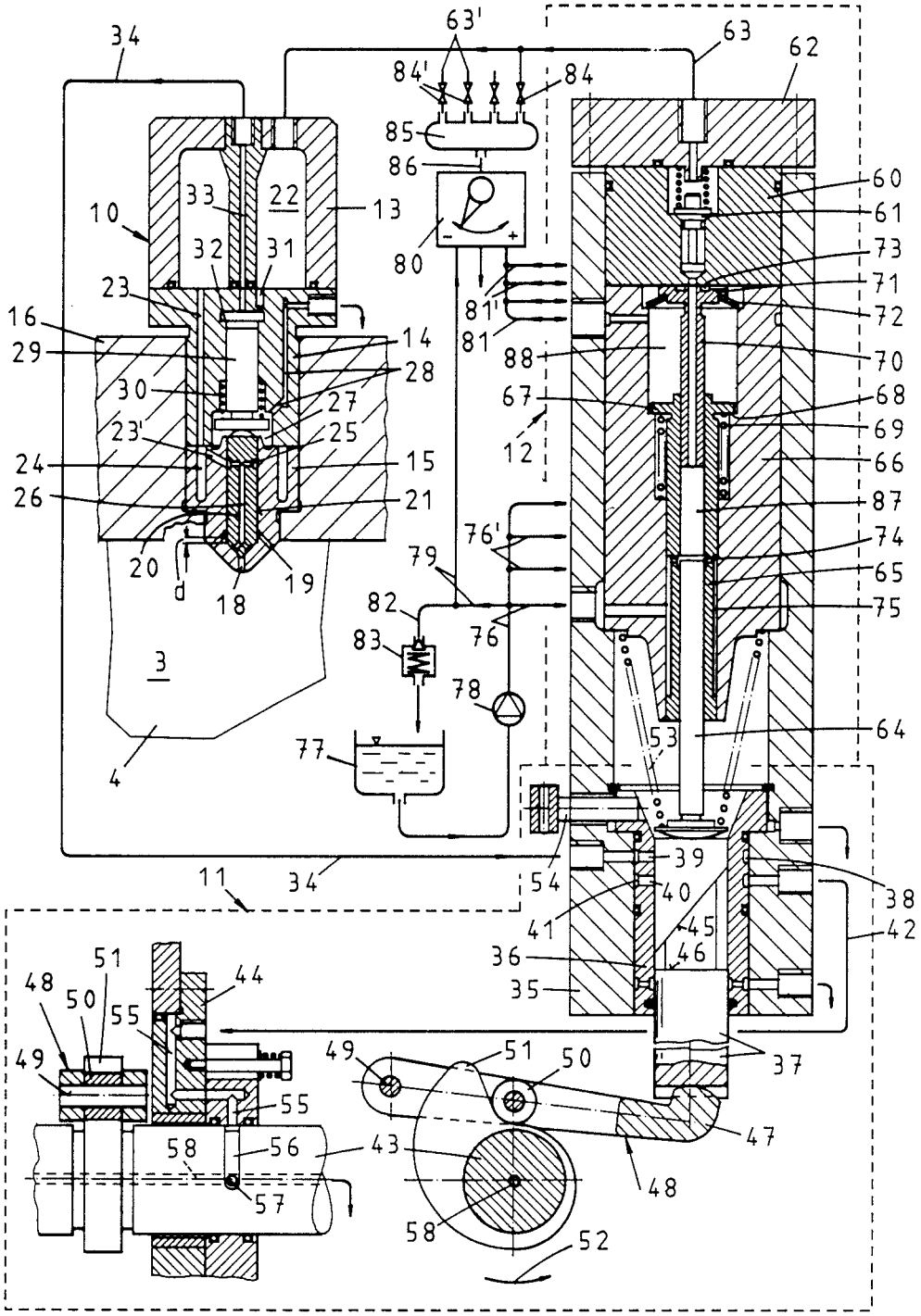

These and other objects and advantages of the invention will become more apparent from the following detailed description taken in conjunction with the accompanying drawings wherein:

FIG. 1 diamgrammatically illustrates a fuel injection device in accordance with the invention for a reciprocating internal combustion engine which can be operated with gas as well as with diesel oil; and FIG. 2 is a detailed illustration of the injection device shown in FIG. 1.

Referring to FIG. 1, a timed injection valve 10 is provided for injecting fuel into a combustion chamber 3 in a cylinder 4 of a reciprocating internal combustion engine (not shown in detail) in which a piston 5 reciprocates. The valve 10 also has an accumulator chamber 22 for a liquid fuel while the bottom end of the valve 10 which is formed with a plurality of injection apertures 18, 19 projects into the combustion chamber 3. As will be described hereinafter, the liquid fuel consists of diesel oil, which is injected either in small quantities as an ignition fuel or in larger quantities as the main fuel. Apart from the diesel oil, gas, which may or may not be mixed with air for combustion, is also fed to the cylinder 4 via a line 6, and is also used as the main fuel, in which case the gas is ignited by the ignition fuel. The engine is a dual-fuel engine which can be operated either with diesel oil as the main fuel or with gas as the main fuel and can operate on the two-stroke or four-stroke principle.

The combustion chamber 3 is defined by the cylinder 4 and the working piston 5 which is adapted to move up and down therein. The diesel oil is fed via a fuel line 76 to a pumping device 12 which delivers the diesel oil at high pressure via a line 63 to the accumulator chamber 22 of the injection valve 10. A relief line 34 from the accumulator chamber 22 leads to a control means 11 by means of which the injection time is controlled.

Referring to FIG. 2, the injection valve 10 comprises a body consisting of a top part 13, a middle part 14 and a bottom part 15, the three parts being held together by suitable means (not shown). The valve body extends through a cylinder head 16 and the bottom end of the bottom part 15 projects into the combustion chamber 3 of the cylinder 4. That end of the part 15 which projects into the combustion chamber 3 has a central injection aperture 18 and, at a spaced apart higher level, a series of additional injection apertures 19 whose axes are at an acute angle to the longitudinal axis of the valve body.

The bottom part 15 of the valve body contains a valve needle 20 of cylindrical cross-section, which is guided in an axial bore 21 of the bottom part 15. The valve needle 20 has an end face facing the combustion chamber 3 which is conical and co-operates sealingly with a corresponding co-acting surface in the bottom part 15. The injection apertures 19, which are connected via an annular groove on the input side, are so disposed that there is a distance "d" between the bottom boundary of this annular groove and the transition from the cylindrical surface of the bore 21 to the conical co-acting surface.

The top part 13 of the valve body contains the accumulator chamber 22 in which fuel for injection is stored at high pressure. Starting from the accumulator chamber 22, a fuel supply duct 23 extends through the middle part 14 and leads into an annular groove 24 in the wall of the bottom part 15. This annular groove 24 extends approximately to the middle of the bore 21 guiding the valve needle 20. The fuel supply duct 23 continues from the annular groove 24 in an inclined bore 23' which leads into the bore 21. In the region of the orifice of the bore 23', the valve needle 20 has an annular groove into which a diametric duct 25 leads. From this duct 25, a central duct 26 in the valve needle leads towards the conical end face. Near this end face, the duct 26 forks into two short ducts, the axes of which are at a right angle to the cone surface. The orifices of the short ducts are widened somewhat so that there are still sealing portions of the conical surface left on either side of each widening and these block the stream of fuel to the injection apertures 18 and 19 when the valve needle 20 is in a closing position.

A central leakage chamber 27 is provided at the bottom end of the middle part 14 and is connected to a leakage duct 28 which is taken out of the part 14 above the cylinder head 16. A loading piston 29 projects from above into the leakage chamber 27 and presses on the valve needle 20 by means of a spring 30 and by means of the fuel pressure in the accumulator chamber 22, such pressure acting on the top end face of the loading piston 29. To this end, a connecting duct 31 is provided in the part 14 and connects the accumulator chamber 22 to the space 32 above the loading piston 29. This duct 31 also has a constriction. The diameter of the loading piston 29 is made somewhat larger than the diameter of the valve needle 20. A relief duct 33 extends from the chamber 32 and leads out of the injection valve 10. A relief line 34 is connected to the relief duct 33 and leads to the control means 11.

The control means 11 serves to selectively move the valve needle 20 cyclically over a first distance to open only the central aperture 18 to eject fuel therefrom as ignition fuel or cyclically over a greater second distance to sequentially open the central aperture and then the additional apertures 19 to eject fuel as ignition fuel and subsequently as main fuel. To this end, the control means comprises a housing 35 in which a spool sleeve 36 and a spool 37 are disposed. In the region of the connection of the relief line 34, the sleeve 36 has an annular groove 38 from which a first control port 39 leads to the inside of the sleeve 36. A second control port 40 is provided axially beneath the first control port 39 in the sleeve 36 and is connected via an annular groove 41 to another relief line 42 connected to the housing 35 and leading to a valve plate 44 fixedly disposed on a cam shaft 43 in stationary relation. The control ports 39, 40 co-operate with two control edges 45, 46 of the spool 37, the top control edge 45 being at an angle to the longitudinal axis of the spool 37.

The bottom end of the spool 37 rests on a free end 47 of a one-armed lever 48 which is pivotable about a pivot 49 at an opposite forked end and bears on a cam 51 on the cam shaft 43 via a roller 50 disposed between the two ends. The cam 51 is a drop cam and when the control means 11 is in operation, rotates in the direction indicated by the arrow 52. To prevent the spool 37 from rotating about its longitudinal axis, the bottom end of the spool 37 is slotted, the lever end 47 engaging in the slot. The spool 37 is pressed against the lever 48 by a conical spring 53 supported in the housing 35. The sleeve 36 is mounted in the housing 35 so as to be non-displaceable axially but can be pivoted about the longitudinal axis of the spool 37 by way of a lever 54.

The point of connection of the additional relief line 42 to the valve plate 44 is connected via a duct 55 to a groove 56 which is disposed in the outer surface of the cam shaft 43 and which extends over just a part of the periphery of the cam shaft 43. The groove 56, in turn, communicates with a central bore 58 in the cam shaft via a radial bore 57. The bore 58 leads to a low-pressure space. Thus, as the cam shaft 43 rotates, there is only a brief connection between the duct 55 and the groove 56.

The pumping device 12 is connected above the control means 11 and has a housing which is shared with the control means 11. As shown, the pumping device 12 has a pump head 60 with a spring-loaded delivery valve 61 at the top end. A fuel delivery line 63 is connected to a pump cover 62 and leads at one end into the accumulator chamber 22 of the injection valve 10 and at the other end into a surge tank 85 via a throttle valve 84. An axially movable piston 64 is provided in the bottom zone of the pumping device 12 in order to deliver the fuel and the bottom end bears on the spool 37 and, because of the conical spring 53, participates in the spool movements. The piston 64 projects into an axially movable cylinder liner 65 which is guided in a stationary housing part 66 in the form of a cylinder. At the top end, the liner 65 has a flange 67 which, in the position illustrated, bears against a shoulder 68 of the cylinder 66. A spring 69 is disposed beneath the flange 67 and tends to lift the flange 67 away from the shoulder 68.

A centrally drilled axially immovable force-balancing piston 70 projects into the top end of the liner 65 with the central bore leading to the delivery valve 61 in the pump head 60. The top end of the piston 70 has a round foot 71 which sealingly bears against the pump head 60 while being radially movable within small limits. This sealing support is provided, on the one hand, by means of a conical spring disc 72 and, on the other hand hydraulically, an annular relief groove 73 being provided of a smaller inside diameter than the outside diameter of the piston 70. The annular groove 73 communicates via a radial groove with the space 88 surrounding the piston 70.

On the inside substantially in the middle, the liner 65 has an annular groove 74 connected via radial bores to a recess 75 formed in the outer surface of the liner 65. A line 76 is connected to the pump housing 35 near the recess 75 and leads from a fuel reservoir 77 and contains a low-pressure feed pump 78. By way of parallel lines 76', the feed pump 78 supplies identically constructed devices of other cylinders of the reciprocating internal combustion engine. From line 76, a line 79 branches off and is connected via a pressure controller 80 and a line 81 to the pump housing 35 just below the foot 71 of the piston 70. In this way, the recess 75, the space 87 between the pistons 64 and 70, the central bore thereof, and the space 88 above the flange 67 are filled with fuel.

An overflow line 82 with a pressure limiting valve 83 is connected to the line 79 and leads back to the fuel tank 77. Lines 81' corresponding to lines 76' are connected to the pressure controller 80 and lead to the other devices. Also, fuel delivery lines 63' corresponding to the fuel delivery line 63 of the other devices are each connected by a throttle valve 84' to the surge tank 85, from which a measuring line 86 leads to the pressure controller 80.

The fuel injection device described operates as follows, assuming that the engine is operating with gas. In the position of the cam 51 shown in FIG. 2, the spool 37 was moved down at very high speed by the powerful conical spring 53 because the rectilinear part of the cam 51, by means of which the roller 50 of the lever 48 had previously been moved down, is inclined only slightly to the radial. The lengths of the arms of the lever 48 are so dimensioned that there is a considerable axial travel involved in the movement of the spool 37, thus enabling the sealing gap between the spool and the surrounding sleeve 36 to be provided over a relatively small diameter so that the inevitable leakage can be kept relatively low.

As the cam shaft 43 continues to rotate in the direction indicated by the arrow 52, the lever 48 is pivoted in a counter-clockwise direction and, in so doing, moves the spool 37 upwards. Simultaneously with this upward movement, the piston 64 is also moved upwards, and when the top end face of the piston 64 has passed the top boundary of the annular groove 74, delivery of the fuel contained in the space 87 starts. The fuel then flows through the bore of piston 70, the opening delivery valve 61 and line 63 to the accumulator chamber 22 of the injection valve 10. In these conditions, the valve needle 20 remains in the closed position since the fuel pressure acts on the valve needle 20 via the loading piston 29. As the spool 37 continues to move upwards, the inclined control edge 45 first passes the lower control port 40 and then the upper control port 39. Although there is now a connection between the relief lines 34, 42 this has no effect on the injection valve 10 because the connection of the line 42 at the valve plate 44 is still blocked since the groove 56 in the cam shaft 43 is now not connected to the duct 55. As the control spool 37 continues to move upwards, the lower control port 40 is closed by the bottom control edge 46, corresponding to a position of the roller 50 of lever 48 just in front of the top of the cam 51.

Once the roller 50 of lever 48 has passed the top of the cam 51, the spool 37 moves down at high speed. As soon as the bottom control edge 46 passes the lower control port 40, the relief lines 34, 42 are connected. This connection acts as a pressure relief because the relief line 42 now communicates via duct 55, groove 56 and bores 57, 58 with a lower-pressure space. Thus, there is a massive pressure drop in the lines 42, 34. This also takes effect on the loading piston 29 in the injection valve 10 via the relief duct 33. Consequently, the pressure of the diesel oil in the accumulator chamber 22, which acts on the valve needle 20 via the ducts 23, 23', 25, 26 so as to lift the needle 20, can move the needle 20 upwards briefly so that fuel is injected via the central injection aperture 18 into the combustion chamber 3. The travel of the valve needle 20 in these conditions is still smaller than the distance "d", so that no diesel oil can escape via the injection apertures 19. The amount emerging via the injection aperture 18 is thus very small and serves as ignition fuel for the gas in the combustion chamber 3.

The relief of the loading piston 29 as described is only momentary, since in the position of the spool sleeve 36 shown in FIG. 2, the axial distance between the control edges 45 and 46 in the region of the ports 39 and 40 is the minimum distance and the inclined control edge 45 blocks the upper port 39, just after the lower port 40 has been cleared by the control edge 46, thus again interrupting the connection between the relief lines 34 and 42.

If the operation of the internal combustion engine is to be changed over from gas to diesel oil as the main fuel, the gas supplied via the line 6 is stopped and the spool sleeve 36 in the control device 11 is pivoted by means of the lever 54. The result is a larger axial distance between the control edges 45, 46 in the area of the control ports 39, 40. This means that, as the spool 37 moves downwards, the connection between the relief lines 34 and 42 and hence the pressure drop above the loading piston 29 are maintained for a longer period than in the case of gas operation described previously. Accordingly, the valve needle 20 has a larger opening stroke so that the diesel oil is also injected via the injection apertures 19 into the combustion chamber. With diesel operation, therefore, a much larger quantity of diesel oil is injected than in the case of gas operation. Otherwise, the device described operates the same as in the case of gas, i.e. on the upward movement of the spool 37 the connection between the relief lines 34 and 42 has no effect because then the duct 55 does not communicate with the groove 56 in the cam shaft 43.

The delivery can also be varied by means of the pumping device 12, this being done as follows by means of the controller 80. The fuel pressure in the accumulator chamber 22 is recorded in the pressure controller 80 via the throttle valve 84, surge tank 85 and measuring line 86. As long as the pressure selected has not yet been reached in the accumulator chamber 22, the pressure controller 80 allows the full pressure of the feed pump 78 to act in the space 88 via the lines 79 and 81, so that the cylinder liner 65 is pressed via the flange 67 onto the shoulder 68. This happens because the balancing piston 70 prevents any hydraulic forces from acting on the liner 65 from the high-pressure side. The axial positioning of the liner 65 is therefore governed only by the equalibrium between the force of the spring 69 and the force of the hydraulic pressure in the space 88. The amount delivered by the piston 64 then corresponds to the maximum delivery.

If the fuel pressure in the accumulator chamber 22 exceeds the selected pressure, the pressure controller 80 reduces the feed pressure so that this reduced pressure also becomes operative in the space 88. Consequently, the cylinder liner 65 supported by the spring 69 can move upwards so that the delivery stroke of the piston 64 starts later. The maximum stroke of the cylinder liner 65 is reached when the top end face bears against the foot 71 of the piston 70. In this position of the cylinder liner, the piston 64 carries out an empty stroke, i.e. the delivery is equal to zero. On the downward movement of the piston 64, vacuum is produced in the delivery chamber 87, which fills up with diesel oil at the feed pump pressure when the top end face of piston 64 reaches the annular groove 74 in the cylinder liner .

The pressure applied to the controller 80 is kept as constant as possible by means of the throttle valves 84, 84' because the pressure of all the adjacent pumping devices is fed to the surge tank 85 after appropriate throttling and thus the pressure is substantially constant against time. The incorporation of the throttle valves and surge tank also has the advantage that in the event of any breakdown of the pumping device 12, the other injection devices still remain operable to some extent.

The invention thus provides a fuel injection device which can be used on an optional basis to inject diesel oil into a combustion chamber as a main fuel to diesel oil as an ignition fuel for gas operation.

Further, the invention permits the injection device to eject a controlled quantity of diesel oil for efficient operation as an ignition fuel for gas or diesel oil operation.

What is claimed is:

1. A fuel injection device for a combustion chamber of a reciprocating internal combustion engine, said device including a timed injection valve having at least one aperture for injection of diesel oil as an ignition fuel into the combustion chamber and additional apertures for injection of diesel oil as a main fuel into the combustion chamber and a valve needle closing over said apertures under the pressure of diesel oil delivered to said valve; and a control means for selectively opening only said one aperture cyclically when the combustion chamber is operated with gas as a main fuel and opening said one aperture and said additional apertures cyclically when the combustion chamber is operated with diesel oil as a main fuel, said control means being connected to said valve to relieve the pressure of the diesel oil delivered to said valve to control movement of said valve needle relative to said one aperture and to said additional apertures.

2. A fuel injection device as set forth in claim 1 wherein said control means includes a sleeve having two axially spaced control ports therein, a first relief line connecting one of said ports with said injection valve to receive pressurized fuel therefrom, a second relief line connected to the other of said ports, a spool slidably mounted in said sleeve and having a pair of control edges for moving over said ports to communicate said ports with each other when positioned between said control edges, a cam for moving said spool in said sleeve and a control member connected to said second relief line for selectively opening said second relief line to a low-pressure space.

3. A fuel injection device as set forth in claim 2 wherein said control means includes a cam shaft for rotating said cam and wherein said control member includes a stationary part about said cam shaft, a duct in said part communicating with said second relief line, a groove extending over a peripheral portion of said cam shaft for selectively communicating with said duct during rotation of said cam whereby said groove is out of communication with said duct during a stroke of said spool into said sleeve.

4. A fuel injection device as set forth in claim 3 wherein said sleeve is rotatable to adjust the position of said ports relative to said control edges.

5. A fuel injection device as set forth in claim 3 which further comprises a pumping device for delivering diesel fuel to said injection valve.

6. A fuel injection device as set forth in claim 5 wherein said pumping device includes a delivery piston bearing on said spool for movement therewith, an axially displaceable cylinder liner having said delivery piston slidably mounted in said liner opposite said delivery piston and having a longitudinal bore extending from a fuel delivery space between said pistons, a delivery valve communicating with said bore and a fuel delivery line extending from said delivery valve to said injection vavle to deliver fuel from said fuel delivery space.

7. A fuel injection device as set forth in claim 6 wherein said cylinder line includes openings at mid-length thereof and which includes a fuel delivery line for delivering diesel oil to said openings for passage into said fuel delivery space.

8. A fuel injection device as set forth in claim 6 which further includes a pump head having said delivery piston therein and a foot on said fixed piston at an end opposite said line and in sealed relation against said pump head.

9. A fuel injection device as set forth in claim 6 which further comprises a housing part having said liner slidably mounted therein and having said fuel delivery space therein, a shoulder on said housing part and a flange on said liner abutting said shoulder in a bottom-most position of said liner.

10. A fuel injection device comprising an injection valve having a chamber for storing fuel at high pressure, at least one aperture for injection of fuel as an ignition fuel from said chamber, additional apertures for injection of fuel as a main fuel from said chamber, and a valve needle closing over said apertures under the pressure of the fuel in said chamber; and control means for selectively moving said valve needle in response to a release of pressure in said chamber cyclically over a first distance to open said one aperture to eject fuel therefrom as ignition fuel and cyclically over a greater second distance to sequentially open said one aperture and said additional apertures to eject fuel therefrom as ignition fuel and sequentially as main fuel.

11. A fuel injection device as set forth in claim 10 which further comprises a pumping device for delivering a pressurized flow of fuel to said chamber in said valve, a loading piston in said valve communicating on one side with said chamber and on an opposite side with said valve needle to hold said valve needle in a closed position under the pressure of fuel in said chamber, a relief line communicating said one side of said loading piston with said control means, and a central duct in said valve needle communicating with said chamber at one end and with a space between said one aperture and said additional apertures at the opposite end.

12. A fuel injection device as set forth in claim 11 wherein said control means selectively opens said relief line to a low pressure space to relieve the pressure of fuel on said loading piston while moving said valve needle under the pressure of fuel in said central duct to open at least said one aperture for ejection of fuel.

13. A fuel injection device as set forth in claim 12 wherein said control means includes a sleeve having two axially spaced control ports therein, a first relief line connecting one of said ports with said relief line to receive pressurized fuel therefrom, a second relief line connected to the other of said ports, a spool slidably mounted in said sleeve and having a pair of control edges for moving over said ports, to communicate said ports with each other when positioned between said control edges, a cam for moving said spool in said sleeve and a control member connected to said second relief line for selectively opening said second relief line to said low-pressure space.

14. A fuel injection device as set forth in claim 13 wherein said control means includes a cam shaft for rotating said cam and wherein said control member includes a stationary part about said cam shaft, a duct in said part communicating with said second relief line, a groove extending over a peripheral portion of said cam shaft for selectively communicating with said duct during rotation of said cam whereby said groove is out of communication with said duct during a stroke of said spool into said sleeve.

15. A fuel injection device as set forth in claim 14 wherein said pumping device includes a delivery piston bearing on said spool for movement therewith, an axially displaceable cylinder liner having said delivery piston slidably mounted therein, a fixed piston slidably mounted in said liner opposite said delivery piston and having a longitudinal bore extending from a fuel delivery space between said pistons, a delivery valve communication with said bore and a fuel delivery line extending from said delivery valve to said injection valve to deliver fuel from said fuel delivery space.

16. A fuel injection device comprising an injection valve having a chamber for fuel, at least one aperture for injection of fuel as an ignition fuel from said chamber, additional apertures for injection of fuel as a main fuel from said chamber, a valve needle closing over said apertures, a loading piston communicating on one side with said chamber and on an opposite side with said valve needle to hold said valve needle in a closed position under the pressure of fuel in said chamber, a relief line communicating with said one side of said loading piston, and a central duct in said valve needle communicating with said chamber at one end and with a space between said one aperture and said additional apertures at the opposite end;

a pumping device for delivering a pressurized flow of fuel to said chamber in said valve: and control means communicating with said relief line for selectively moving said valve needle cyclically over a first distance to open said one aperture to eject fuel therefrom as ignition fuel and cyclically over a greater second distance to sequentially open said one aperture and said additional apertures to eject fuel therefrom as ignition fuel and sequentially as main fuel.

17. A fuel injection device as set forth in claim 16 wherein said control means selectively opens said relief line to a low pressure space to relieve the pressure of fuel on said loading piston while moving said valve needle under the pressure of fuel in said central duct to open at least said one aperture for ejection of fuel.

18. A fuel injection device as set forth in claim 17 wherein said control means includes a sleeve having two axially spaced control ports therein, a first relief line connecting one of said ports with said relief line to receive pressurized fuel therefrom, a second relief line connected to the other of said ports, a spool slidably mounted in said sleeve and having a pair of control edges for moving over said ports to communicate said ports with each other when positioned between said control edges, a cam for moving said spool in said sleeve and a control member connected to said second relief line for selectively opening said second relief line to said low-pressure space.

19. A fuel injection device as set forth in claim 18 wherein said control means includes a cam shaft for rotating said cam and wherein said control member includes a stationary part about said cam shaft, a duct in said part communicating with said second relief line, a groove extending over a peripheral portion of said cam shaft for selectively communicating with said duct during rotation of said cam whereby said groove is out of communication with said duct during a stroke of said spool into said sleeve.

20. A fuel injection device as set forth in claim 19 wherein said pumping device includes a delivery piston bearing on said spool for movement therewith, an axially displaceable cylinder liner having said delivery piston slidably mounted therein, a fixed piston slidably mounted in said liner opposite said delivery piston and having a longitudinal bore extending from a fuel delivery space between said pistons, a delivery valve in communication with said bore and a fuel delivery line extending from said delivery valve to said injection valve to deliver fuel from said fuel delivery space.

* * * * *